US010000983B2

(12) United States Patent
Jackson et al.

(10) Patent No.: US 10,000,983 B2
(45) Date of Patent: Jun. 19, 2018

(54) FLOW BACK JET PUMP

(71) Applicant: Tech Flo Consulting, LLC, Conroe, TX (US)

(72) Inventors: William J. Jackson, Conroe, TX (US); Erik J. Reissig, Conroe, TX (US)

(73) Assignee: Tech-Flo Consulting, LLC, Conroe, TX (US)

( * ) Notice: Subject to any disclaimer, the term of this patent is extended or adjusted under 35 U.S.C. 154(b) by 0 days. days.

(21) Appl. No.: 14/982,962

(22) Filed: Dec. 29, 2015

(65) Prior Publication Data

US 2016/0130894 A1 May 12, 2016

Related U.S. Application Data

(63) Continuation of application No. 14/474,912, filed on Sep. 2, 2014, now abandoned.

(51) Int. Cl.

| | |
|---|---|
| ***E21B 43/12*** | (2006.01) |
| ***E21B 23/00*** | (2006.01) |
| ***F04F 5/48*** | (2006.01) |
| ***F04F 5/46*** | (2006.01) |

(52) U.S. Cl.

CPC ..... *E21B 23/00* (2013.01); *E21B 43/124* (2013.01); *F04F 5/463* (2013.01); *F04F 5/464* (2013.01); *F04F 5/48* (2013.01)

(58) Field of Classification Search

USPC ..... 166/68, 68.5, 105

See application file for complete search history.

(56) References Cited

U.S. PATENT DOCUMENTS

| | | | | |
|---|---|---|---|---|
| 2,778,428 A | | 1/1957 | Baker et al. | |
| 3,052,302 A | | 9/1962 | Lagucki | |
| 3,543,852 A | * | 12/1970 | Taylor | E21B 23/10 166/155 |
| 3,633,668 A | | 2/1972 | Vazquez et al. | |
| 4,658,893 A | | 4/1987 | Black | |
| 4,753,577 A | | 6/1988 | Black et al. | |

(Continued)

FOREIGN PATENT DOCUMENTS

| | | |
|---|---|---|
| GB | 2410044 | 7/2005 |
| WO | 2013003958 | 1/2013 |

OTHER PUBLICATIONS

USPTO Office Action for U.S. Appl. No. 14/474,912 dated Jun. 29, 2015.

(Continued)

*Primary Examiner* — Giovanna C. Wright
*Assistant Examiner* — Ronald R Runyan
(74) *Attorney, Agent, or Firm* — Tumey L.L.P.

(57) ABSTRACT

A jet pump assembly is adapted to be releasably attached to a tubular member of a tubular string in an oil well. The jet pump may be pumped out of the tubular string to the surface by a reverse flow of power fluid down the well between the tubular string and the casing of the well. Consequently the jet pump may be serviced or reconfigured to a direct pumping mode without the necessity of a wire line or other apparatus. A sensor for measuring downhole parameters such as temperature and pressure etc. is positioned within a cavity located in a lower portion of the jet pump so as to be removable from the well with the pump.

2 Claims, 3 Drawing Sheets

(56) References Cited

U.S. PATENT DOCUMENTS

| | | | | |
|---|---|---|---|---|
| 4,860,825 | A * | 8/1989 | Corteville | E21B 43/124 166/105 |
| 5,055,002 | A | 10/1991 | Roeder | |
| 5,083,609 | A | 1/1992 | Coleman | |
| 5,372,190 | A | 12/1994 | Coleman | |
| 7,044,241 | B2 | 5/2006 | Angman | |
| 7,114,572 | B2 | 10/2006 | Batho et al. | |
| 7,717,182 | B2 | 5/2010 | Butler | |
| 2014/0003965 | A1 | 1/2014 | James | |

OTHER PUBLICATIONS

International Search Report and Written Opinion for Application No. PCT/US2015/048072 dated Dec. 22, 2015.
USPTO Office Action for U.S. Appl. No. 15/596,840 dated Sep. 19, 2017.

* cited by examiner

FLOW BACK JET PUMP

This application is a continuation of application Ser. No. 14/474,912 filed Sep. 2, 2014.

BACKGROUND OF INVENTION

1. Field of the Invention

This invention relates to jet pumps that are used to lift fluids such as water and oil from the interior of an oil well. Pumps of this type utilize a nozzle and a venturi tube to create a pressure drop which can draw fluid from a location in the well below the pump. The power fluid and produced fluid from the well are then comingled in a mixing tube and diffuser where the pressure is increased to a point where the power and produced fluids are forced to the surface of the well where the produced fluids can be separated.

2. Description of Related Art

Jet pumps as described above are known that include a subassembly of the pump to be circulated back to the surface for servicing for example, by reverse flow of the power fluid. In normal operation, power fluid under pressure is pumped down a tubular positioned within the well casing and the mixture of the power fluid and produced fluid is conveyed upwardly in the annulus between the tubular and the casing. To pump back certain subassemblies for service, for example, the power fluid is pumped down the annulus and forces the subassembly up through the tubular.

Also, jet pumps are known that can be operated in a direct flow or reverse flow configuration. The nozzle assembly can be retrieved at the surface and replaced by a reverse flow nozzle arrangement. In this configuration, it is necessary to provide a stop mechanism to prevent the nozzle assembly from being pumped back to the surface in the reverse flow position. The stop mechanism may include a plurality of dogs on the pump housing which extend into an annular pocket found on the interior surface of a sub that surrounds the pump housing. A conventional tool may be used to pivot the dogs out of the pocket when it is desired to remove the inner components of the jet pump.

However, the prior art does not include an entire jet pump assembly that can be installed in the reverse flow mode and subsequently removed from the tubular string without the use of a wire line.

BRIEF SUMMARY OF THE INVENTION

The invention disclosed and claimed herein is directed to a jet pump of the type discussed above that can be totally removed from the tubular string. The pump is releasably held in place for reverse flow operation and can be removed by a tool that can be pumped down to the pump without the use of a wireline.

The tool is adapted to release locking dogs attached to the pump assembly and at the same time to attach to a fishing neck at the top portion of the pump assembly. The tool includes seals that engage the interior surface of the tubular string to facilitate the pumping out of the entire pump assembly when desired. In this manner the entire pump assembly can be removed from the tubular string as a unit without the necessity of a wireline or work over rig.

BRIEF DESCRIPTION OF THE SEVERAL VIEWS OF THE DRAWING(S)

DETAILED DESCRIPTION OF THE INVENTION

Figure 1:
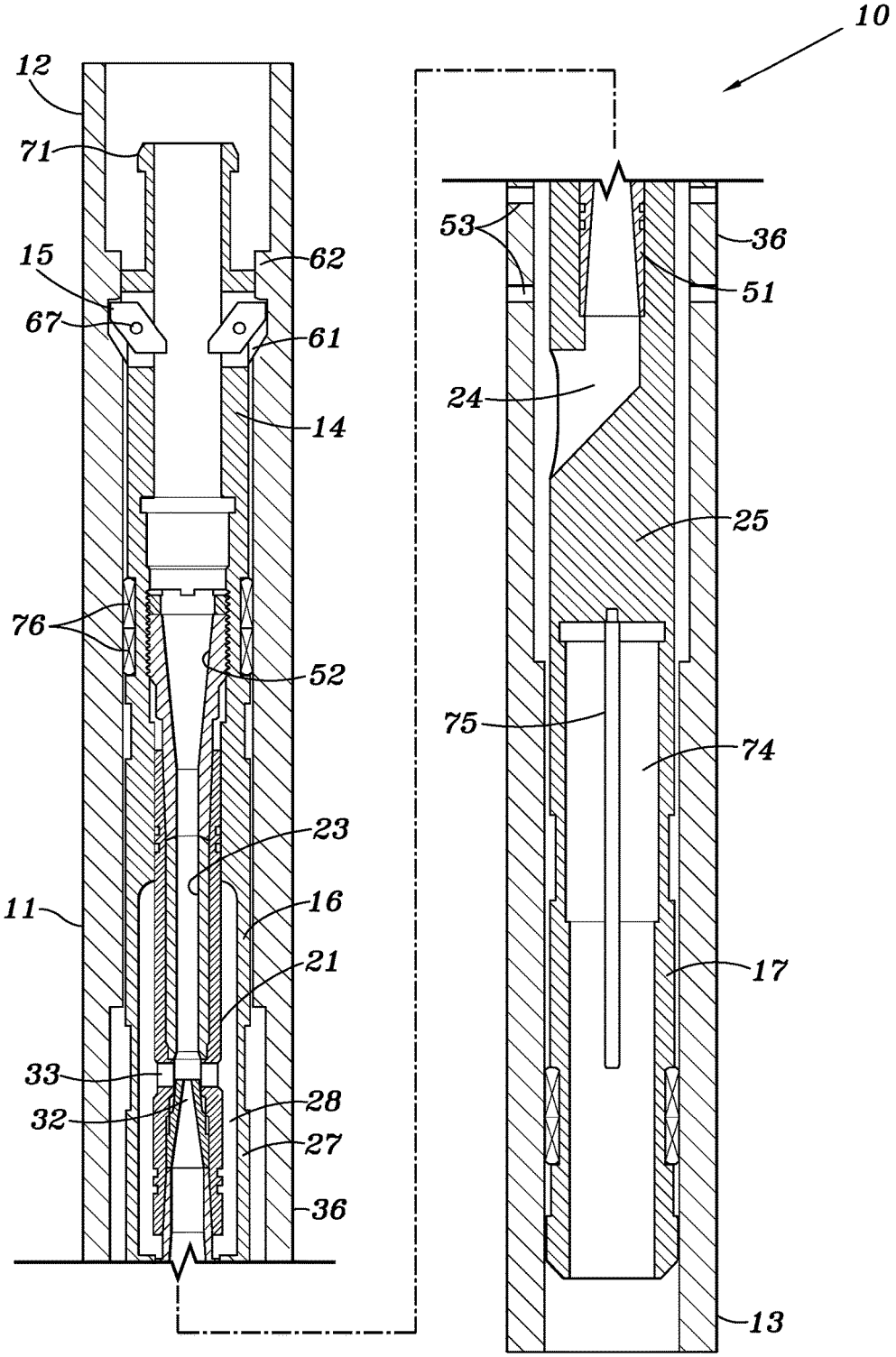
FIG. 1 is a cross-sectional view of the pump unit positioned within a tubular and in the reverse flow mode

Referring to FIG. 1 the jet pump assembly 10 according to an embodiment of the invention is positioned within an outer tubular member 11 having an upper end 12 and lower end 13 adapted to be connected to a tubular string which extends within the casing (not shown) of an oil/gas well. Outer tubular member 11 is generally of the same diameter of the tubular string such that an annual gap exists between the outer surface of the outer tubular member 11 and the casing of a well. The upper end 12 of tubular member 11 includes an annular shoulder 62 and an annular recess 61. Recess 61 receives a plurality of pivotably mounted dogs 15 pivoted at 67 that cooperate with shoulder 62 to normally prevent upward movement of the jet pump unit within tubular member 11 when the jet pump assembly is in the reverse flow mode as shown in FIG. 1.

The jet pump assembly includes a jet pump housing 16 having an upper portion 14, intermediate portions 27, 22 and a lower portion 25. Lower portion 25 includes a lateral, diverging port 24 which in the reverse flow mode shown in FIG. 1 acts as an inlet port. In the direct flow mode port 24 acts as an outlet port. A sensor 75 for sensing downhole parameters such as pressure and temperature etc. is attached to a bottom portion 17 of lower portion 25 of the jet pump housing within a cavity 74.

Figure 2:
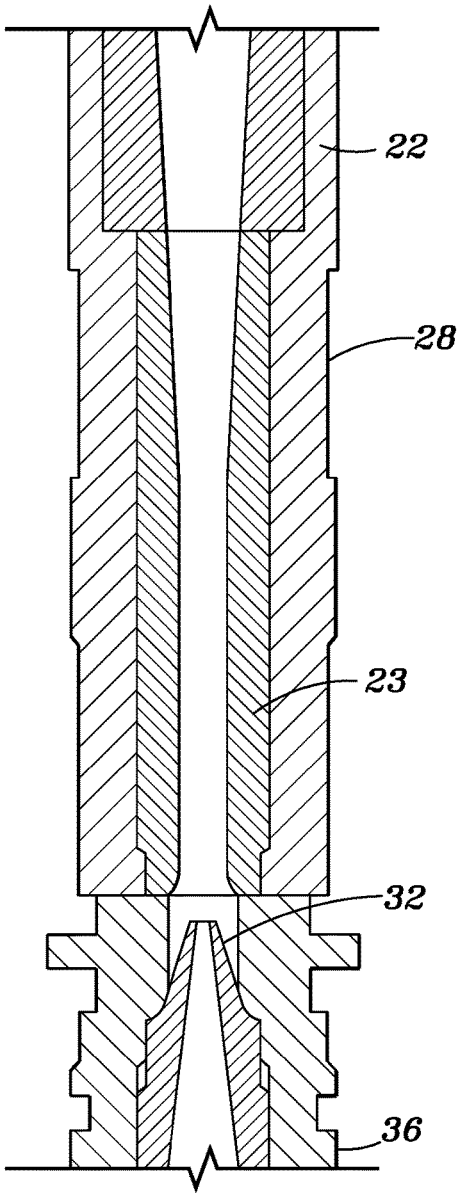
FIG. 2 is a cross-sectional view of the nozzle and carrier assembly.

A carrier member 21 is positioned within jet pump housing 16 and provides support for a mixing tube 23 and a jet nozzle 32 as shown in FIG. 2. A plurality of apertures 33 are provided in the carrier member 21 adjacent jet nozzle 32.

In the configuration shown in FIG. 1, power fluid is pumped down the annulus between the casing and tubular string and enters the interior of tubular member 11 through a plurality of apertures 53 provided in middle portion 36 of tubular member. The power fluid then enters port 24 and converging passageway 51 of the carrier member. At this point the velocity of the power fluid is increased and the pressure is reduced as is well known in the art.

As the power fluid exits nozzle 32, a further pressure reduction occurs and formation fluid is drawn up through lower portion 17 of the jet pump housing 16. The produced fluid passes through apertures 33 from a chamber 28 and is subsequently mixed with the power fluid in mixing tube 23. From there the mixture expands in divergent passageway 52 where the velocity decreases and the pressure increases thus enabling the mixture of power fluid and produced fluid to flow upwardly to the well head.

Should it be desired to retrieve the entire jet pump assembly for example, in order to service the pump or to reconfigure it to operate in a direct mode with the power fluid pumped down the tubular string, the entire jet pump assembly can be pumped up without the need of a wire line in the following manner.

Figure 3:
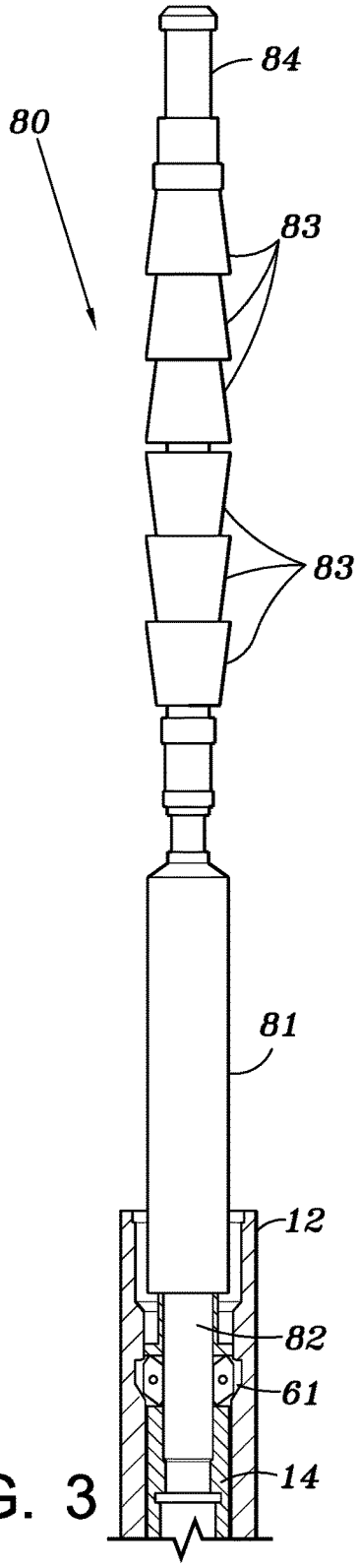
FIG. 3 is a view of the retrieving tool attached to an upper portion of the jet pump.

An attachment tool 80 as shown in FIG. 3 is pumped down to engage the jet pump assembly. Attachment tool 80 includes a cylindrical body portion 81 and a cylindrical rod 82 extending downwardly from body portion 81. Rod 82 engages dogs 15 to move them out of annular recess 61. At the same time, latches within body 81 of the tool engage fishing neck 71 of the jet pump housing and upper portion 14 in a manner known in the art.

Attachment tool 80 also includes a plurality of seal cups 83 which engage the inner surface of the tubular string. Thus after the dogs 15 have been moved out of annular recess 61 and fishing neck 71 has been engaged, the entire pump assembly including jet pump housing 16 and carrier 21 may be pumped up by fluid entering through port 24.

Figure 4:
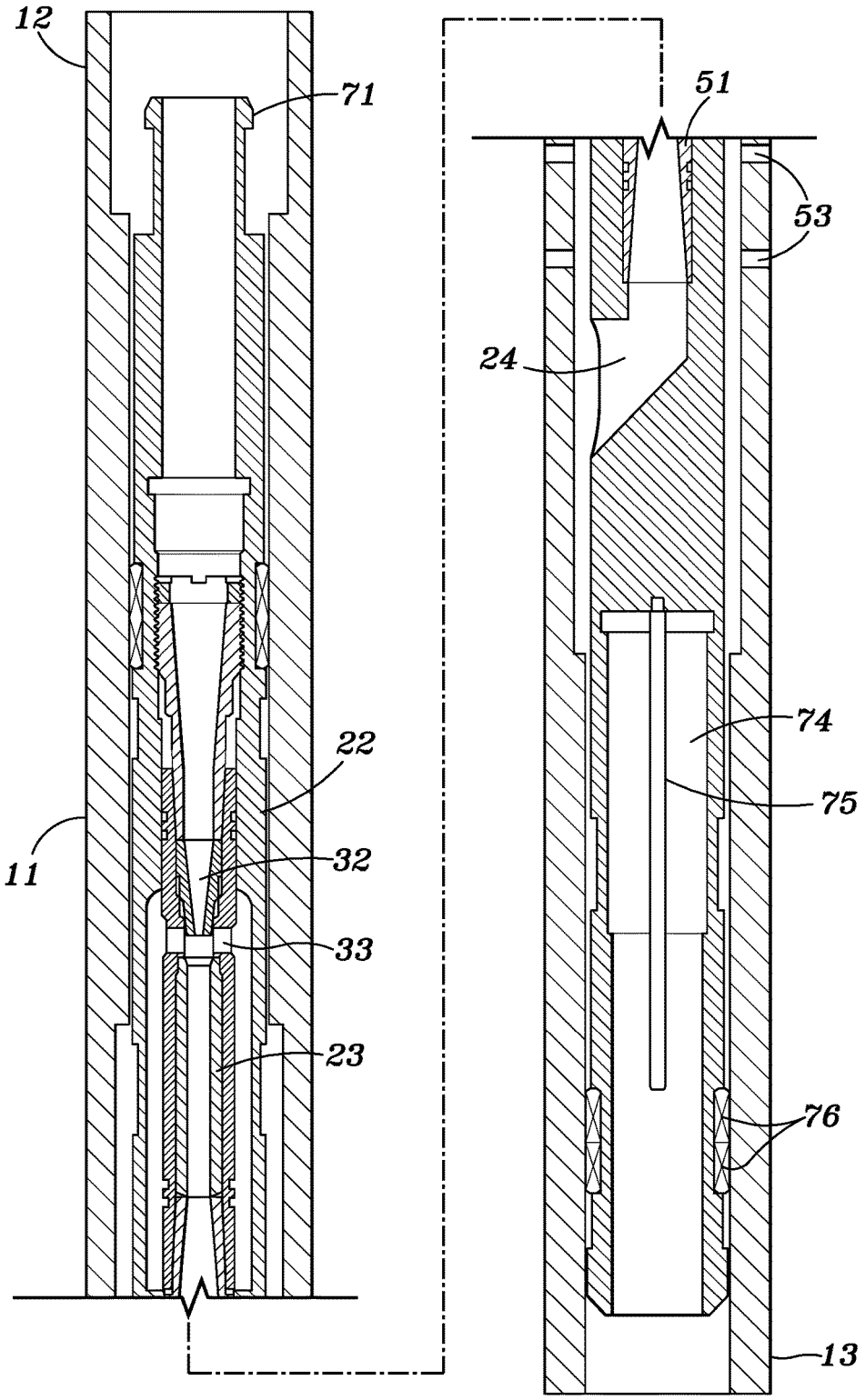
FIG. 4 is a cross-sectional view of the pump unit in a direct flow mode.

The pump may be reconfigured to a direct flow mode by repositioning the nozzle 32 and mixing tube 23 such that power fluid will pass down the tubular string to first enter the nozzle and then flow into the mixing tube 23 and diffuser 51 as shown in FIG. 4. A plurality of seals 76 are positioned between the pump housing and tubular 11.

An example of a well know attachment tool that may be utilized is the model BT "JDC" pulling tool made by Brace Tool located in Alice, Tex. It has been modified by inclusion of the seal cups 83 and an upper fishing neck 84.

Although the present invention has been described with respect to specific details, it is not intended that such details should be regarded as limitations on the scope of the invention, except to the extent that they are included in the accompanying claims.

We claim:

1. A method of removing a jet pump from a tubular string positioned within the casing of a well comprising;

providing an attachment tool adapted to be pumped down the tubular string and adapted to be pumped up to a surface of the well without the use of a wireline, pumping the attachment tool down the tubular string to engage and attach to the jet pump, pumping the attachment tool and the jet pump to the surface of the well by pumping fluid in a downwardly direction between the tubular string and the well casing, wherein the jet pump includes a latching mechanism for securing the jet pump in the tubular string and the attachment tool includes a rod that releases the latching mechanism.

2. The method of claim 1 wherein the attachment tool includes latches for engaging a fishing neck provided on the jet pump.

* * * * *